US005555934A

United States Patent [19]

Haufler

[11] Patent Number: 5,555,934

[45] Date of Patent: Sep. 17, 1996

[54] MULTIPLE WELL JET PUMP APPARATUS

[75] Inventor: Michael D. Haufler, Westminster, Md.

[73] Assignee: R. E. Wright Environmental, Inc., Middletown, Pa.

[21] Appl. No.: 489,434

[22] Filed: Jun. 12, 1995

[51] Int. Cl.[6] ..... E21B 43/00

[52] U.S. Cl. ..... 166/68; 166/105; 417/172

[58] Field of Search ..... 166/105, 265, 166/372, 68; 210/117, 104, 130; 417/172, 179, 125, 138

[56] References Cited

U.S. PATENT DOCUMENTS

| | | | |
|---|---|---|---|
| 3,326,290 | 6/1967 | Cabely | 166/68 |
| 4,157,847 | 6/1979 | Williams et al. | 166/62 X |
| 4,171,016 | 10/1979 | Kempton | 166/68 |
| 4,297,081 | 10/1981 | Irvin | 417/2 |
| 4,390,061 | 6/1983 | Short | 166/68 X |
| 4,469,170 | 9/1984 | Farmer, Jr. | 166/265 |
| 4,603,735 | 9/1986 | Black | 166/68 |
| 4,761,225 | 8/1988 | Breslin | 166/265 |
| 5,013,218 | 5/1991 | Spencer | 166/265 |
| 5,083,609 | 1/1992 | Coleman | 166/68 |
| 5,207,897 | 5/1993 | Baird et al. | 166/265 |
| 5,262,065 | 11/1993 | Hansen | 166/265 |
| 5,326,458 | 7/1994 | Johnson | 166/265 |
| 5,372,190 | 12/1994 | Coleman | 166/68 |
| 5,490,561 | 2/1996 | Cardoso-Neto et al. | 166/264 |

*Primary Examiner*—Frank Tsay
*Attorney, Agent, or Firm*—Martin Fruitman

[57] ABSTRACT

The apparatus is a pumping system for multiple wells which uses a single circulating pump and two or more venturi jet pumps, at least one jet pump for each well. The circulating pump furnishes feed water to the several jet pumps, with the vacuum line of each jet pump installed into a different well. Automatic level control within the well is furnished because when the liquid level falls, the jet pump vacuum line within the low level well draws air, and there is no effect on the pumping action of the jet pumps of other wells. Thus, if the level of liquid in a well drops, that pump simply pumps air and will resume pumping the liquid when the liquid once again covers the well pipe intake.

7 Claims, 2 Drawing Sheets

MULTIPLE WELL JET PUMP APPARATUS

BACKGROUND OF THE INVENTION

This invention deals generally with separating material entering wells and more specifically with a multiple well pumping system which is automatically responsive to the flow into and the liquid level within the well.

Many installations for the removal of contaminants from ground water use one or more wells. Many such systems pump water up to the surface separately in order to create a "cone of depression" in the region so that contaminants dissolved in ground water, those which float atop the ground water and those which sink in ground water can be collected. However, most systems, even those systems which do not separately pump out the contaminants, must pump out considerable quantities of contaminated ground water to purify it.

Such multiple well systems have several features in common. If they use multiple pumps, the systems are usually quite complex and expensive because each pump in each well requires separate controls. If, on the other hand, a system uses a single pump for multiple wells, it is likely that the pumping action of each well will be affected by all the other wells.

For instance, one type of multiple well system uses a single vacuum pump connected to a manifold from which pipes are run to several wells. Such multiple well system have severe operational problems because all the wells can stop operating if the level of liquid in any one well drops below the location of the well pipe intake. Under such circumstances, the well without liquid at the intake sucks in air and the vacuum in all the other wells fails, so all pumping stops. The conventional manner in which this failure is prevented is to constantly adjust the flow from each well to match the flow into the well in order to keep the liquid levels in all the wells above the intakes. Such action requires complex controls and/or constant surveillance of the equipment by experienced personnel, since the flow into any well can change unpredictably.

Other multiple well systems use individual pumps within every well, but both the electric submersible pumps and the pneumatic pumps typically used for this purpose are costly because multiple pumps are required, and they have limitations in regard to their difficulty in handling low flow rates. The pneumatic systems are limited due to the requirement of the drive compressors to operate at a minimum duty cycle, that is, to operate a certain minimum portion of each time period. Thus, there is a low flow limit for the wells below which there is not sufficient operation of the compressors.

Electric submersible pumps have similar low flow limits, and they also require individual motor starters for each pump. They also have another limitation which adds significantly to the cost of their use. The conventional manner in which the liquid level in a well is controlled is by locating sensors, usually conductivity probes or float switches, within the well so that the sensors turn the pump on and off. However, since wells used for the removal of contaminants must be assumed to have volatile vapors present, for electric pumps all such controls in the wells must be explosion proof. This not only adds to the cost of the initial installation but also to the maintenance of such systems.

SUMMARY OF THE INVENTION

The present invention overcomes all these weaknesses in the conventional systems by furnishing a multiple well pumping system which automatically controls the liquid level in the well, which requires nothing more than one or two pipes to be placed in the wells, which has no low flow limitations, and which eliminates pumping system interaction among the wells of the multiple well installation.

This is accomplished by using a single water circulating pump to draw water from a storage tank and supply water under pressure to several venturi jet pumps, each of which independently creates the vacuum for a single well. The vacuum created draws the water in the well down to the intake depth, at which point both air and water are extracted, and the water level is fixed. The outputs of the jet pumps, which include both the circulating water fed to the jet pumps and water and air raised from the wells, is then returned to the water tank, from which the water and gases raised from the wells are delivered to a treatment facility.

The water tank, the circulating pump, and the multiple jet pumps can all be located on a single platform above the ground, and all that need be lowered into the wells are simple pipes with no control devices at all. This is because of the unique characteristics of the invention and the use of venturi jet pumps. Even for pumping water levels located more than about 25 feet below the tank, only the jet pumps need to also be placed within the wells.

The conventional jet pump operates because the circulating water is forced through a venturi nozzle which creates a vacuum in the region adjacent to the venturi nozzle. It is this vacuum which draws only the water within the well back up to the jet pump. This principle is used in many residential wells in which a single jet pump is placed within the well.

The invention takes advantage of the simplicity of the jet pump and drives at least two of them from a single circulating pump. Therefore, the cost of installing additional wells in a system only increases the system cost by the cost of the quite inexpensive single jet pump and simple pipes for each additional well. Furthermore, such a system provides automatic well water level control for each individual well without the use of any auxiliary controls, and the condition or operation of any well does not affect the operation of any of the other wells in the system, even though they are all driven from the same circulating pump.

The automatic level control and the isolation between the wells results from each jet pump creating a vacuum independent of all the other jet pumps. Thus, if the water level in one well drops below the pipe intake, all that happens is that the single well draws air up to its jet pump rather than pumping water. This does not affect the other jet pumps and is not only not harmful, but because aeration of contaminated water is part of the contaminant purification technique, the air drawn from the well can be helpful.

The automatic water level control action is dependent upon the water level dropping below the pipe intake in wells which have a low inflow of water. Since the water pumping automatically stops when the water level in the well drops too low, the well will gradually recover until the water level rises and pumping resumes, and water pumping will simply stop again when the water level drops below the pipe intake. This simple cycling of the pumping of the water maintains the water level in the well very close to the level of the pipe intake and does so without any separate controls. All that need be placed in the well is the open end of a pipe.

For multiple well systems this automatic control eliminates the previously required balancing of the pumping from several wells to accommodate each well to the quantity of water flowing into the well. Furthermore, this automatic level control is virtually maintenance free and, without auxiliary controls, is extremely simple to install.

The invention includes one completely passive control device which can be attached to the pipe in the well to improve the system performance, particularly when there is a need to remove only the water. This may be desirable when, as in many systems, there is a second pumping system in each well to recover the contaminants floating atop the water in the well.

The control added to the system is a simple pipe tee installed above the pipe intake. The tee is installed with its straight through section inserted into the pipe and the transverse section of the tee creating an opening in the side of the pipe. An elbow is then attached to the transverse section of the tee and an open top standpipe extending vertically up the well is attached to the elbow. The standpipe, or snorkel, is generally extended above the natural ground water level.

This simple structure prevents the jet pump from drawing up liquid contaminants floating atop the water in the well. The standpipe causes water to be drawn into the pipe and up to the jet pump only from the pipe intake below the tee in the pipe, where the water is relatively clean. Moreover, when air is drawn into the pipe it is only from the top of the stand pipe which can be located so that it will either draw relatively clean air or a mixture of vapor and air. The only other effect of the tee and the standpipe is that the water level in the well is maintained at the level of the tee rather than at the location of the pipe intake.

A typical multiple well pumping system of the invention uses a multiple horsepower centrifugal pump to drive multiple jet pumps at 50–80 psi with 3 to 10 gallons of water per minute through each jet pump. These conditions create a vacuum in each jet pump of up to −28 inches of mercury and provide flows of up to 30 gallons per minute from depths of up to 100 feet. Of course, as described above, the flow automatically adjusts itself downward to any smaller rate, including zero flow.

The invention therefore furnishes a low maintenance multiple well pumping system which is simple to install and operate. The invention also maintains set liquid levels within each of the several wells without requiring any adjustment to do so and assures that no floating contamination will be drawn into the water pumping system.

DETAILED DESCRIPTION OF THE INVENTION

Figure 1:
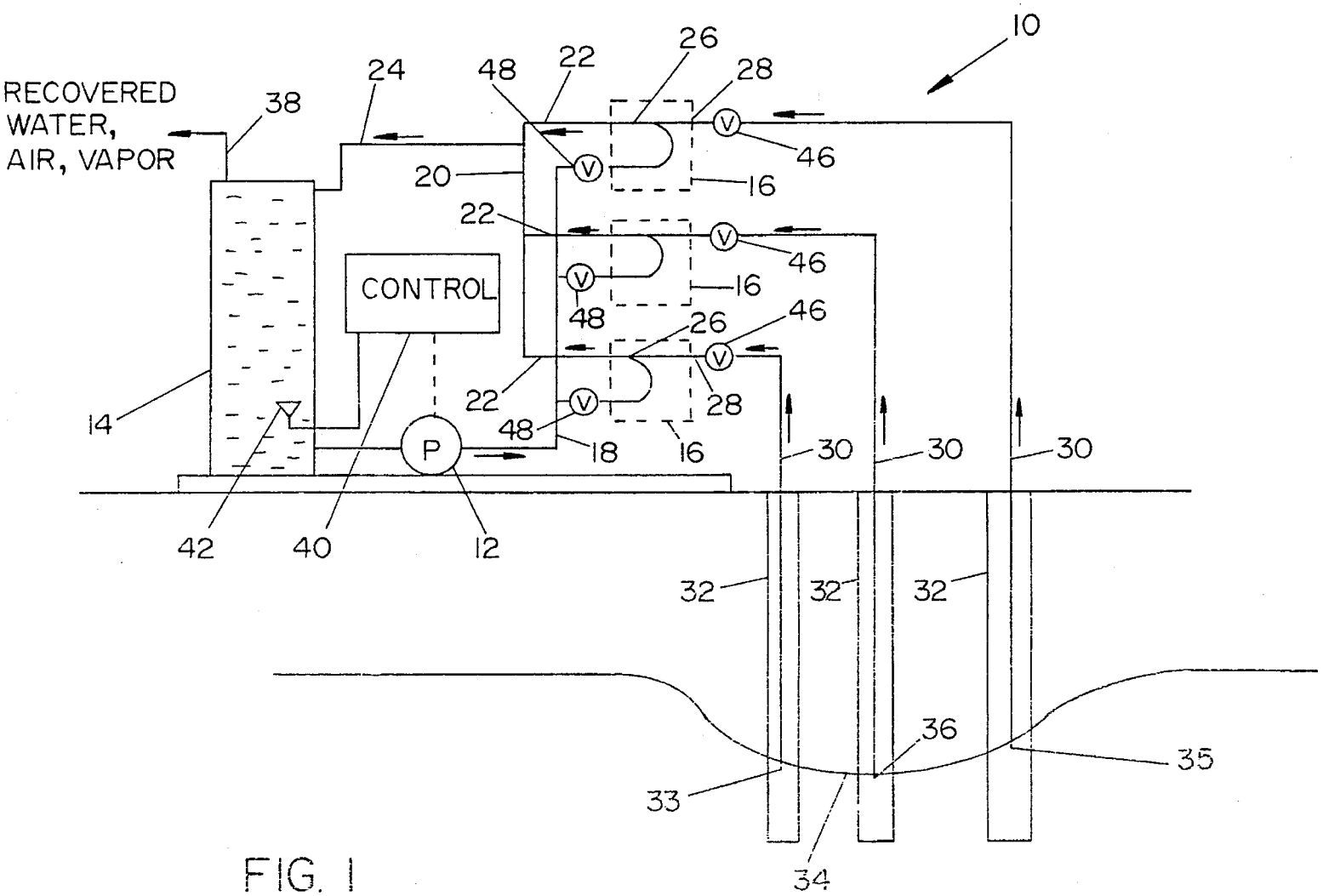
FIG. 1 is a simplified schematic diagram of the preferred embodiment of the invention.

FIG. 1 is a simplified schematic diagram of the preferred embodiment of the invention in which multiple well pumping system 10 includes circulating pump 12 which pumps water from storage tank 14 to the several venturi jet pumps 16 through input manifold 18. Water leaving jet pumps 16 moves into output manifold 20 from outlet pipes 22, and then returns to tank 14 through return pipe 24.

Jet pumps 16 each include venturi 26, which, due to the water flow created in jet pump 16 by circulating pump 12 creates a vacuum at jet pump inlet 28. Pipes 30 are connected to inlets 28 of jet pumps 16, so that water from within wells 32 is drawn up into pipes 30 and into jet pumps 16 by the vacuum created by venturi 26. In jet pumps 16, the water from the wells mixes with the water pumped into the jet pumps from circulating pump 12 and all the water is delivered to water tank 14.

Tank 14 is furnished with outlet pipe 38 which delivers an amount of water equivalent to that raised from wells 32 to another location (not shown) for purification or disposal. Outlet pipe 38 also delivers gases raised from the wells to the treatment location with the water. The water and gases leaving tank 14 are actually driven by pump 12, which produces a slight positive pressure in tank 14 as it pumps the circulating water through the jet pumps. It is also possible to permit the gases and liquid to separate within the tank and to use a separate outlet for the gases.

Jet pumps 16 provide a unique advantage for multiple well pumping system 10. Because each jet pump 16 produces a vacuum which is completely independent of the vacuum created in the other jet pumps, the level of ground water 34 in each well 32 is automatically regulated at the level at which pipe intake 36 is positioned without affecting the other wells. Of course, if the water flow into a well exceeds the pumping rate, or if the water level is dropping but has not yet reached the level of the pipe intake, water level 34 will be above the pipe intake, as shown at intakes 33 and 35. However, when water level 34 is at or drops below the pipe intake, as shown at intake 36, that particular jet pump and pipe will stop pumping water and instead draw in air. Therefore, with no water leaving the well, the flow of ground water into the well will tend to raise the water level again until that jet pump once more is pumping water. This control action requires no separate controls and acts completely automatically.

It is, however, sometimes desirable to add some control devices to multiple well pumping system 10. Circulating pump 12 requires control 40 to at least provide the ability to turn the pump on and off. It is also sometimes desirable to include other safety controls, such as low level sensor 42 within tank 14, to shut off pump 12 if a malfunction causes tank 14 to begin to run dry. Other optional controls in the multiple well system of the invention are jet pump inlet valves 46 and jet pump circulating water input valves 48 to permit individual jet pumps to be taken out of service if necessary.

Figure 2:
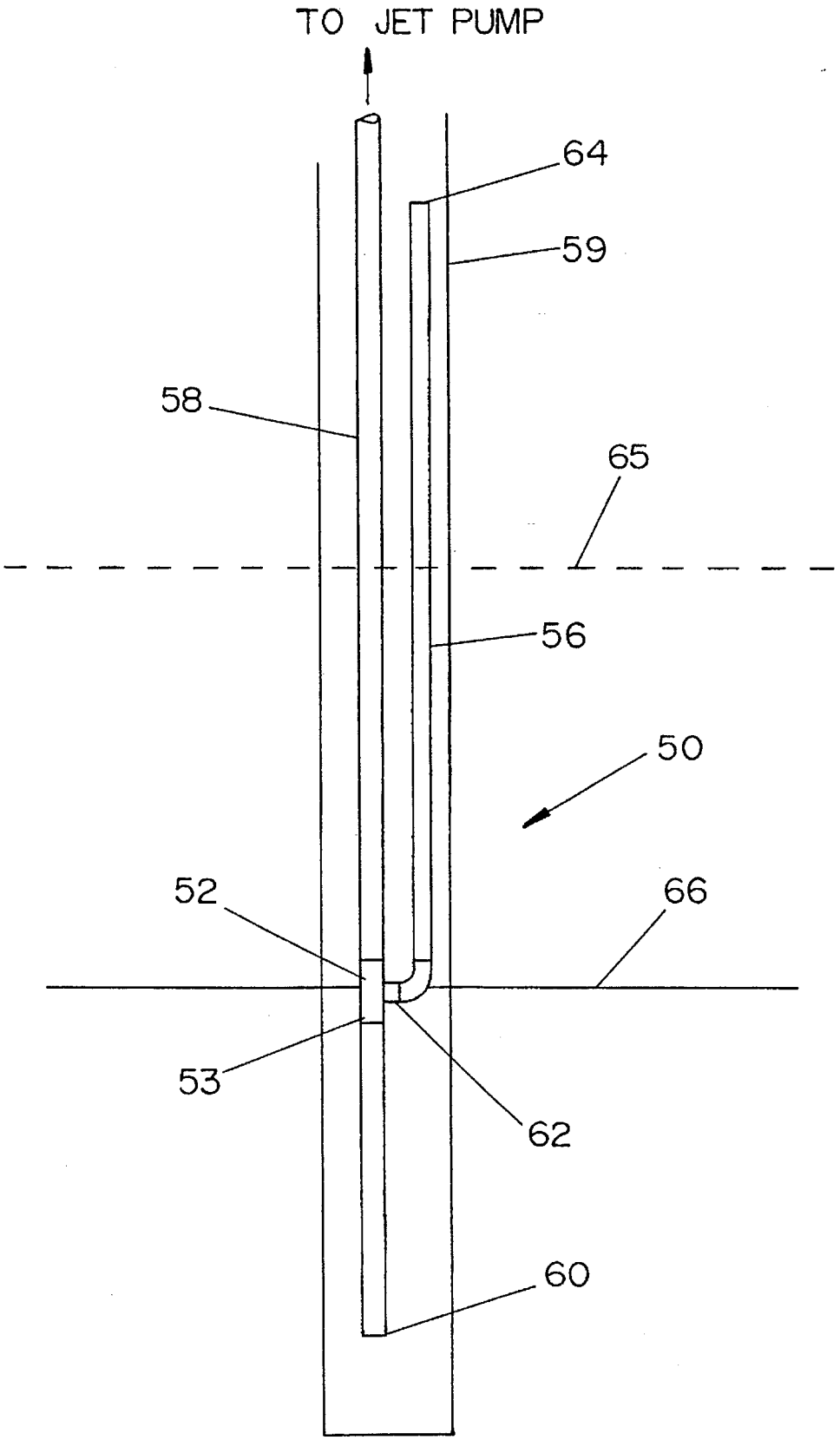
FIG. 2 is a vertical side view of the reduced contaminant pumping automatic level control apparatus of the invention.

FIG. 2 is a vertical side view of reduced contaminant automatic level control 50 of the invention. As can be seen in FIG. 2, the structure of automatic liquid level control 50 is very simple. All that is required is that vertically rising and open stand pipe 56 be connected to and sealed around an opening in pipe 58 which is located above pipe intake 60.

This is easily accomplished with pipe tee 52 inserted in pipe 58 within well 59 and located above pipe intake 60, with straight through section 53 of tee 58 in line with pipe 58 and transverse section 62 of tee 58 connected to vertically rising standpipe 56. Elbow 54 can conveniently be used to connect standpipe 56 to tee 52. Standpipe 56 is open at a location 64 above the location of tee 52. Opening 64 is also typically located above the original ground water level 65 to prevent material floating in the well at the ground water level from entering the system when it is not operating. Pipe 58 is connected to and furnishes fluids from well 56 to a jet pump as shown in FIG. 1.

Automatic level control 50 operates similarly to the level control system described in regard to FIG. 1, but level control 50 has the added benefit of greatly limiting the amount of liquid contaminants pumped into water tank 14 (FIG. 1).

This benefit is attained because any air pumped into pipe 58 actually originates from open location 64 of standpipe 56 which can be located well above the contaminants floating on top of ground water level 66. Most of the contaminants are usually located on top of the ground water. Similarly, liquid pumped into pipe 58 originates at pipe intake 60 which is below the major source of contaminants, the layer floating on top of ground water level 66.

Despite these widely separated sources of liquid and vapor, level control 50 operates to control ground water level 66 within well 59 at the level of transverse section 62 of elbow 52. It should be appreciated that as the water level drops in well 59 it also drops in standpipe 56 because, with opening 64 high on standpipe 56 and accessible to the air around pipe 58, the air pressure is the same in both the well and the standpipe. Therefore, as the water level drops, and the water opens transverse section 62 to empty standpipe 56, air (from opening 64 in standpipe 56) enters pipe 58 and water is no longer drawn into pipe 58. However, as the water level rises and closes off transverse section 62, the water drawn into pipe 58 is only accessible from the bottom of pipe 58 at intake 60. Therefore, the contaminants floating atop the ground water never have access to pipe 58. No floating contaminants are therefore pumped to ground level by the pumping system of the invention.

The invention thereby furnishes a simple multiple well pumping system which provides several well pumps, all powered by the same circulating pump, each of which are independent of the others and which automatically control the liquid level in their respective wells without the requirement for any electrical connections within the well.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For example, more or fewer than the three pumps shown in FIG. 1 could be used, and jet pumps 16 could be placed within the wells to raise ground water from greater depths. Furthermore, the well pipe of any jet pump could be detached, and the system would continue to operate, while merely drawing harmless air through the jet pump intake.

What is claimed as new and for which Letters Patent of the United States are desired to be secured is:

1. A multiple well pumping apparatus comprising:

at least two venturi jet pumps, each jet pump with a venturi input, a vacuum inlet, and an outlet;

a circulating pump interconnected with and delivering liquid to the venturi input of each jet pump; and pipes interconnecting at least one jet pump vacuum inlet to a liquid intake within a well.

2. The multiple well pumping apparatus of claim 1 further including a tank with at least one outlet, at least one inlet, and a feed pipe interconnected with and supplying water to the circulating pump; and pipes interconnecting each jet pump outlet to a tank inlet.

3. The multiple well pumping apparatus of claim 2 wherein the tank outlet removes gases mixed with the liquid from the tank.

4. The multiple well pumping apparatus of claim 2 further including a sensor within the tank which prevents operation of the circulating pump when the liquid level is below a set level.

5. The multiple well pumping apparatus of claim 1 further including valves on the venturi input and the vacuum inlet of a jet pump.

6. The multiple well pumping apparatus of claim 1 further including a liquid level control apparatus attached to a pipe within a well, with the liquid level control apparatus comprising:

an opening in the pipe with the opening located above the pipe liquid intake; and a standpipe connected to and sealed around the opening in the pipe, with the standpipe having an opening accessible to the air outside the pipe and the standpipe opening located above the opening in the pipe.

7. A liquid level control apparatus attached to a pipe within a well, with the pipe interconnected with a pump capable of pumping both liquids and gases from the well, and with the liquid level control apparatus comprising:

an opening in the pipe, with the opening located above a liquid intake on the pipe; and a standpipe connected to and sealed around the opening in the pipe, with the standpipe having an opening accessible to the air outside the pipe, and the standpipe opening located above the opening in the pipe.

* * * * *